United States Patent [19]

Pasternack

[11] 4,300,547

[45] Nov. 17, 1981

[54] RESPIRATOR HAVING MEANS FOR COOLING INHALATION AIR

[75] Inventor: Adalbert Pasternack, Bad Schwartau, Fed. Rep. of Germany

[73] Assignee: Drägerwerk Aktiengesellschaft, Fed. Rep. of Germany

[21] Appl. No.: 142,149

[22] Filed: Apr. 21, 1980

[30] Foreign Application Priority Data

May 8, 1979 [DE] Fed. Rep. of Germany ..... 2918456

[51] Int. Cl.[3] ..... A62B 7/08

[52] U.S. Cl. ..... 128/202.26; 128/204.15; 165/DIG. 10

[58] Field of Search ..... 128/201.13, 204.15, 128/205.17, 207.15, 204.13, 202.26, 204.16; 165/163, DIG. 10

[56] References Cited

U.S. PATENT DOCUMENTS

| | | | |
|---|---|---|---|
| 3,095,255 | 6/1963 | Smith | 165/DIG. 10 |
| 3,638,655 | 2/1972 | Doherty | 128/207.15 |
| 3,794,030 | 2/1974 | Cotabish et al. | 128/202.26 |
| 3,814,091 | 6/1974 | Henkin | 128/205.17 X |
| 3,983,869 | 10/1976 | Suzuki | 128/204.13 |

FOREIGN PATENT DOCUMENTS

| | | | |
|---|---|---|---|
| 63958 | 10/1955 | France | 128/204.15 |

*Primary Examiner*—Henry J. Recla
*Attorney, Agent, or Firm*—McGlew and Tuttle

[57] ABSTRACT

A respirator includes an arrangement for receiving exhalation air from a person for circulating this air which advantageously has been enriched with oxygen and treated to remove carbon dioxide through an inhalation line. The inhalation line is covered with a sheath of material which can be wetted with a liquid so that when the liquid evaporates the inhalation line is cooled.

6 Claims, 1 Drawing Figure

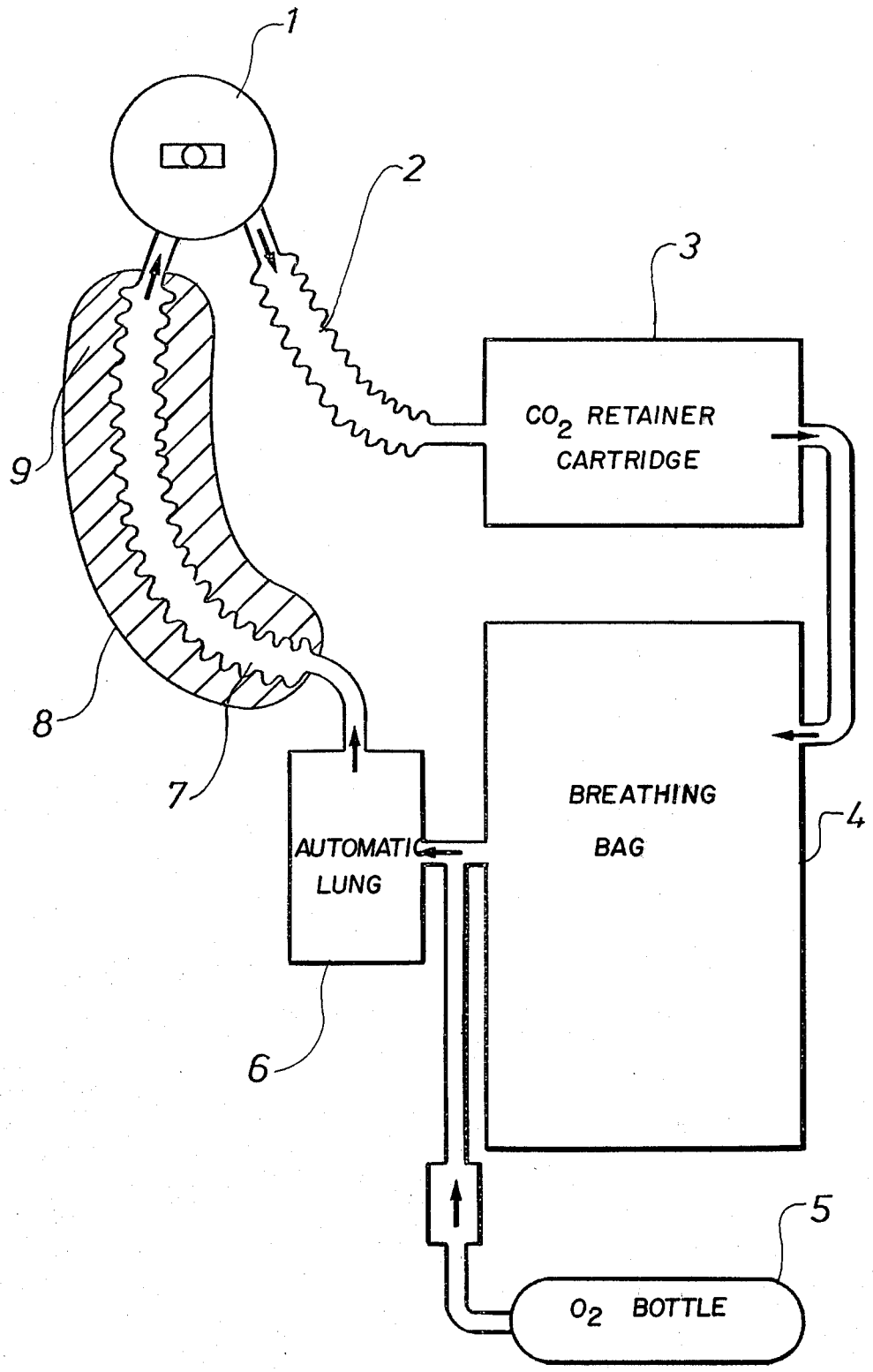
1
2
3
$CO_2$ RETAINER CARTRIDGE
9
8
7
AUTOMATIC LUNG
BREATHING BAG
4
6
5
$O_2$ BOTTLE

RESPIRATOR HAVING MEANS FOR COOLING INHALATION AIR

FIELD AND BACKGROUND OF THE INVENTION

This invention relates in general to respirators and in particular to a new and useful arrangement for cooling the inhalation line of such respirators.

Respirators are classified as cycle devices and as oscillatory respirators. In the first group the cycled respiratory air is sent for regeneration through a carbon dioxide absorption cartridge and then returned to the wearer after addition of the consumed oxygen. In the second group, the exhalation air is passed through a chemical cartridge into a respiration bag and is thence inhaled again as inhalation air by the same route. In the chemical cartridge the carbon dioxide is bound and oxygen is chemically set free, so that the oxygen is replaced. The chemical processes in the absorption cartridge in the cycle cartridge and in the chemical cartridge of the oscillatory respiration method are exothermic.

A known respirator with cycled respiratory air contains, in a housing chamber with a breathing bag and in another chamber, the material absorbing the carbon dioxide. The consumed oxygen is replenished from an oxygen bottle disposed below the housing and passed via a line to the chamber with the breathing bag. Into this chamber is passed also the exhalation air after having been freed from the carbon dioxide in the other chamber. Above the first chamber, in another chamber, is a liquid coolant, possibly water ice, which in liquid form wettingly penetrates through connecting tubes into a covering of an absorbent porous material pulled around the housing. The surrounding air can flow over the covering and in so doing it can evaporate the moisture. With the negative heat of evaporation the cycled respiratory air heated in the carbon dioxide-absorbing material is to be cooled. The cooling effect greatly depends on the quantity ratios of the ambient air conducted externally of the covering and of the respiratory air conducted inside the housing on the cooled outside wall. Besides, the wearer of the device must continuously carry the entire coolant supply together with the respirator. (DE-PS No. 12 50 272).

Another known respirator with oscillatory respiration consists of a $CO_2$ binding and oxygen releasing chemical cartridge connected at one end to a breathing bag and at the other end to a mouthpiece. Between the mouthpiece and the chemical cartridge, a heat exchanger is interposed, which is alternately traversed by the inhalation air as well as by the exhalation air. The heat exchanger may be disposed either near the mouthpiece, at mid-length of the breathing tube, or in the upper portion of the chemical cartridge. The heat exchanger may consist of a packet of metal wires, chips, screens or the like. It is to operate by serving as moisture trap during the exhalation phase, with which moisture it then cools the inhalation air by evaporation during the inhalation phase. This presupposes a very dry inhalation air. (DE-PS No. 12 59 207).

SUMMARY OF THE INVENTION

The invention provides an arrangement to effect the cooling of the inhalation air in respirators operating by the cycle as well as by the oscillatory process at a minimum of cost of instrumentation, light weight, and insignificant burden to the wearer for control.

In accordance with the invention an inhalation line which provides air for inhaling to a user is covered with a sheath of material which may be wetted by a liquid so that when the liquid evaporates the line will be cooled. The material used is advantageously an absorbent textile, but it may also be a sponge type plastic or similar material such as rubber or other sheath having a porous surface.

Sheathing of the breathing hose carrying the respiratory air, the inhalation hose in the devices on the cycle principle and, in the devices with oscillatory respiration, the single breathing hose present there, makes it easy to install a heat exchanger. For it to function, it suffices to wet the material of the sheath to obtain cooling of the hose material, and if the inhalation air is hot, by evaporation of the water resulting from the water vapor partial pressure difference. Due to the good heat transfer between the material of the sheath and the breathing hose and due to the low thermal capacity of the respiratory air, the latter will cool off quickly.

The user of the device will find it extremely easy to watch the moisture and hence the functioning of the heat exchanger. As the sheath starts to become dry, it simply has to be rewetted. This is very easy to do by applying water from the outside. By using absorbent material, a high water capacity is possible, and with the porous surface the sheath has a large effective evaporation area, which greatly aids the cooling.

Accordingly, it is an object of the invention to provide in a respirator which includes inhalation fitting which may, for example comprise a mouthpiece to be placed in the mouth of the wearer and breathing air circulating means connected to the inhalation fitting which includes an inhalation line to which the breathing air is directed and with the further improvement comprising a sheath of material surrounding the inhalation line and advantageously providing a wettable media which can be wetted with the liquid subject to evaporation so as to cool the inhalation line.

A further object of the invention is to provide a respirator which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the Drawings:

The only FIGURE of the drawings is a schematic representation of a respirator constructed in accordance with the invention.

DESCRIPTION OF THE PREFERRED EMBODIMENTS

Referring to the drawing in particular, the invention embodied therein comprises a fitting generally designated 1 which may, for example, comprise a mouthpiece insertable into the user's mouth with means for circulating breathing air through the fitting which advantageously includes an inhalation line 7 and an exhalation or return line 2 connected to a $CO_2$ retainer cartridge for removing the carbon dioxide from the breath and also to a breathing bag 4 and to an oxygen supply or oxygen bottle 5 and an automatic lung 6 for delivering oxygen enriched and $CO_2$ reduced breathing air through the inhalation line 7 to the fitting 1 and to the user.

The embodiment shows the arrangement for the cooling of the inhalation air on the respirator with cycling of the respiratory air. The exhalation air flows through the breathing nipple 1 which can be placed in the user's mouth. Breathing air moves through an exhalation hose 2 into the carbon dioxide absorption cartridge 3, which are connected to the nipple 1. The cartridge 3 is such that the carbon dioxide of the exhalation air is bound in an exothermic reaction. The purified but heated exhalation air then passes into the breathing bag 4. Breathing air flows, in the inhalation phase, with introduction of oxygen from the oxygen bottle 5 through an automatic lung 6 and a breathing hose 7 carrying the inhalation air, back to the breathing nipple 1. Despite utilization of all possibilities of cooling, the respiratory air is insufficiently cooled before the breathing hose 7.

The breathing hose 7 includes an imperforate tubular portion that is surrounded, with good heat conduction contact, by a sheath 8 of an absorbent material 9 mounted on and including the imperforate tubular portion.

The material 9 may be a textile material, a sponge, or compositions of a plastic or rubber material, for example. By the evaporation of the water introduced by wetting the absorbent material 9, as a result of the water vapor partial pressure difference in the material 9 and the ambient atmosphere, there occurs a cooling of the inhalation air conducted through the breathing hose 7. The wearer of the respirator is supplied with a pleasantly temperature-controlled inhalation air.

While a specific embodiment of the invention has been shown and described in detail to illustrate the application of the principles of the invention, it will be understood that the invention may be embodied otherwise without departing from such principles.

What is claimed is:

1. An improved respirator of the type having a chemical absorption cartridge for exothermically fixing carbon dioxide and generating oxygen, a breathing conduit means connected to the chemical absorption cartridge for passing expiratory air from a person using the respirator into said cartridge and inhalation air from the cartridge to the person using the respirator, and wherein the breathing conduit means has an imperforate tubular portion, the improvement, in combination therewith, comprising means for evaporatively cooling the conduit means, said cooling means comprising a sheath of a liquid-absorbent material mounted on and encircling the imperforate tubular portion whereby when said liquid absorbent material is wetted, the heated inhalation air will evaporate the liquid and thereby cooled.

2. In a respirator according to claim 1, wherein said sheath material comprises an absorbent textile.

3. A respirator according to claim 1 wherein said sheath material is a sponge type plastic.

4. A respirator according to claim 1, wherein the sheath material is a sponge type rubber.

5. A respirator according to claim 1, wherein said sheath material comprises a material having a porous surface.

6. An improved respirator of the type having a chemical absorption cartridge for exothermically fixing carbon dioxide in generating oxygen, a breathing conduit means connected to the chemical absorption cartridge for passing breathing air between the cartridge and a person using the respirator, the breathing conduit means having an imperforate tubular portion, the improvement comprising means for cooling the conduit means consisting essentially of a sheath of a liquid absorbent material mounted on and encircling the imperforate tubular portion whereby when said liquid absorbent material is wetted, the heated inhalation air will evaporate the liquid and thereby be cooled.

* * * * *